United States Patent [19]

Trussell

[11] 4,005,356

[45] Jan. 25, 1977

[54] IGNITION WAVE ANALYZER INTERFACE

[75] Inventor: Gerald C. Trussell, Park Ridge, Ill.

[73] Assignee: Sun Electric Corporation, Chicago, Ill.

[22] Filed: June 16, 1975

[21] Appl. No.: 587,519

[52] U.S. Cl. ..... 324/15

[51] Int. Cl.[2] ..... F02P 17/00

[58] Field of Search ..... 324/15, 16 S

[56] References Cited

UNITED STATES PATENTS 3,777,559 12/1973 Rennick et al. ..... 324/16 S

*Primary Examiner*—Stanley T. Krawczewicz

*Attorney, Agent, or Firm*—Allegretti, Newitt, Witcoff & McAndrew

[57] ABSTRACT

An interface for an ignition coil voltage analyzer is disclosed. The interface includes adaptive sample-and-store logic for secondary peak amplitude detection. The interface also generates timing pulses to effect and facilitate secondary voltage analysis, including frequency component analysis and time domain analysis.

17 Claims, 9 Drawing Figures

POSITIVE REFERENCE COMPARITOR

IGNITION WAVE ANALYZER INTERFACE

BACKGROUND OF THE INVENTION

The present invention relates generally to an ignition voltage analyzer and more particularly to an interface for interconnecting or coupling the pick-up and output of an ignition voltage analyzer.

It is well known today that the conditions and performance of an automotive ignition system can be determined and evaluated by analysis of the ignition signal waveforms and particularly the secondary ignition coil waveform. The primary and secondary coil voltages are very rapid, time varying signals.

Although satisfactory in a limited sense, much of the presently available automotive test equipment is functionally inadequate for complete and thorough analysis of the waveforms. For example, electromagnetic and electrostatic cathode ray tubes are extensively used for display of the ignition wave signals. Unfortunately, the amplitude variations are often too rapid for tracking by the oscilloscope. Thus, the displayed voltage is incomplete as well as inaccurate.

This difficulty or shortcoming is particularly significant with respect to the peak amplitude of the secondary coil voltage, i.e., the firing voltage. The rapid collapse of the primary coil magnetic field induces a substantially spontaneous high voltage in the secondary coil. The rapid rise of the secondary coil voltage substantially prohibits the measurement of peak voltage, although a significant factor in evaluating engine performance.

The rapid signal variations and inability of the presently known equipment to accurately track also substantially prohibit use or utilization of a digital processor. That is, the ignition voltage signals cannot be "held" a sufficient period of time for analog-to-digital conversion, i.e., digitization.

Additionally, various ignition system components, such as the ignition coil, cannot be tested directly with the presently known equipment. The component must be removed from the system for indirect analysis. This operation requires the time-consuming, frequently destructive task of disconnection and, more significantly, prohibits performance measurements under true operating conditions.

SUMMARY OF THE INVENTION

In a principal aspect, the present invention is an interface for an ignition waveform processor. The interface receives and conditions the ignition system waveform for display and/or further analysis.

More particularly, the interface, in response to the primary and secondary ignition signals, generates various fundamental timing pulses or pulse series, defining time slots or windows for performance of ignition analysis tests. The tests are, therefore, initiated with respect to the ignition signals, such that time scaling of the test pulses in relation to engine speed is substantially avoided.

The interface also effects data acquisition, i.e., the sampling and storing of various signal voltages, whereby adequate time is developed for display on an output device, such as an oscilloscope. Additionally, the stored ignition sample may be digitized for transmission, as input, to a processing unit.

It is thus an object of the present invention to provide an interface for an automotive ignition analyzer.

It is a further object of the present invention to provide an improved interface for receipt and conditioning of the ignition waveforms, whereby accurate ignition data is gathered for analysis.

It is also an object of the present invention to provide an ignition analyzer interface having sample-and-store capabilities to accurately track the rapidly fluctuating ignition waveforms.

It is another object of the present invention to provide an interface having bipolar sample-and-store capabilities.

It is yet another object of the present invention to provide an ignition analyzer interface for generating timing pulses to initiate system performance testing.

It is still another object of the present invention to provide an interface for producing test timing pulses in response to the ignition signals.

It is also an object of the present invention to provide an ignition analyzer interface applicable to conventional and solid state, or electronic, ignition systems.

These and other objects, features and advantages of the present invention will become apparent in the following detailed description.

BRIEF DESCRIPTION OF THE DRAWING

A preferred embodiment of the present invention will be described, in detail, with reference to the drawing wherein.

DETAILED DESCRIPTION OF THE PREFERRED EMBODIMENT

Figure 1:
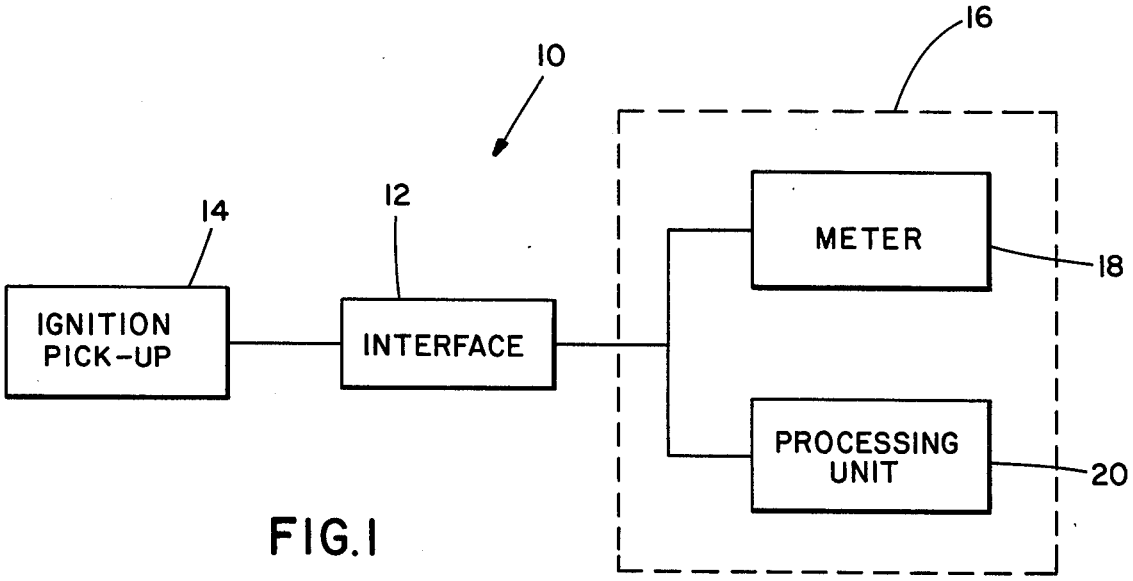
FIG. 1 is a block diagram of an ignition wave analyzer including and incorporating a preferred embodiment of the present invention.

Referring to FIG. 1, a preferred embodiment of the present invention is shown as a part of an ignition waveform processor 10. The present invention is designated as an interface 12. The interface 12 interconnects an ignition pick-up 14 and an output 16, including a meter display or oscilloscope 18, and a processing unit or computer 20. The pick-up 14 is coupled to the coil of an automobile ignition system (not shown) for transmission of the primary and secondary coil voltage signals, PRI+ and $\overline{\text{IGIN}}$, respectively, to the interface 12 and unit 20 for processing therein.

The ignition waveform processor 10 analyzes the undisturbed secondary coil waveshape to determine the operating characteristics of the automobile ignition system. The interface 12, utilizing the primary and secondary coil signals, generates various timing pulses to effect analysis.

Figure 3:
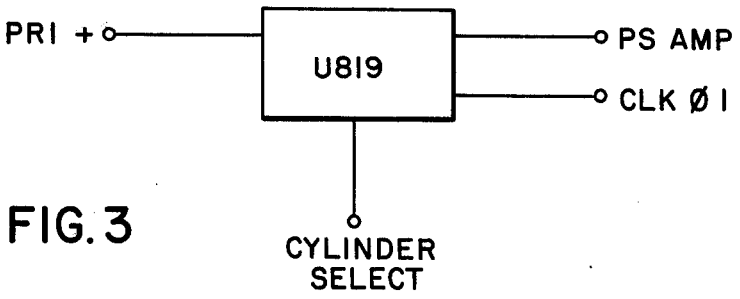
FIG. 3 is a block diagram of an apparatus for generating signals PSAMP and CLK01 for use in the preferred embodiment shown in FIG. 1.

The fundamental timing pulses include the signals CLK01, PSAMP and DSTROB. Referring to FIG. 3, the signals CLK01 and PSAMP are generated by a logic circuit, referenced U819. The U819 logic is described in detail in U.S. Pat. No. 3,788,129, incorporated by reference herein.

Figure 6:
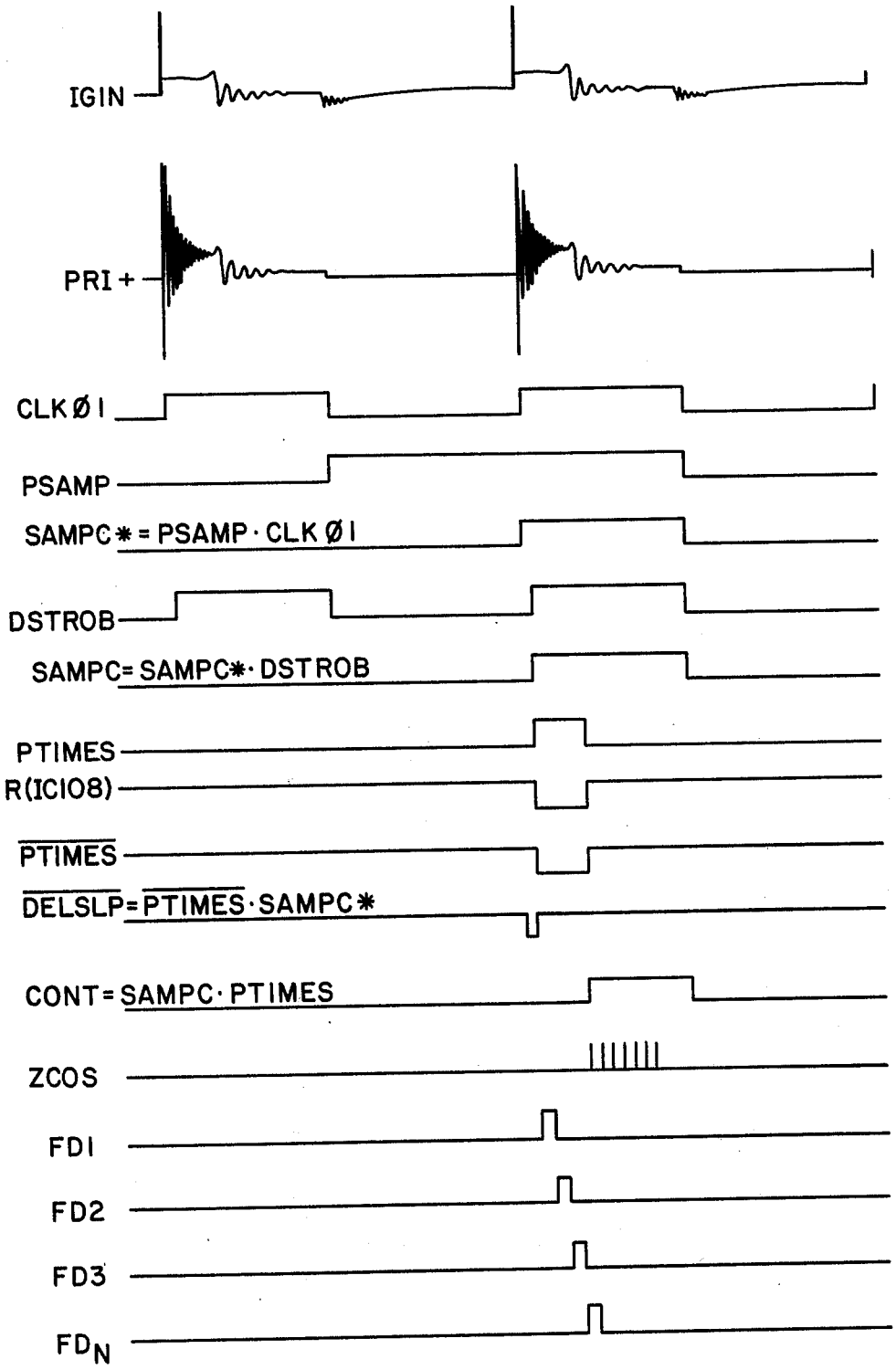
FIG. 6 illustrates the ignition waveforms and signal pulses generated by the preferred embodiment shown in FIG. 1 in response thereto.
Figure 7:
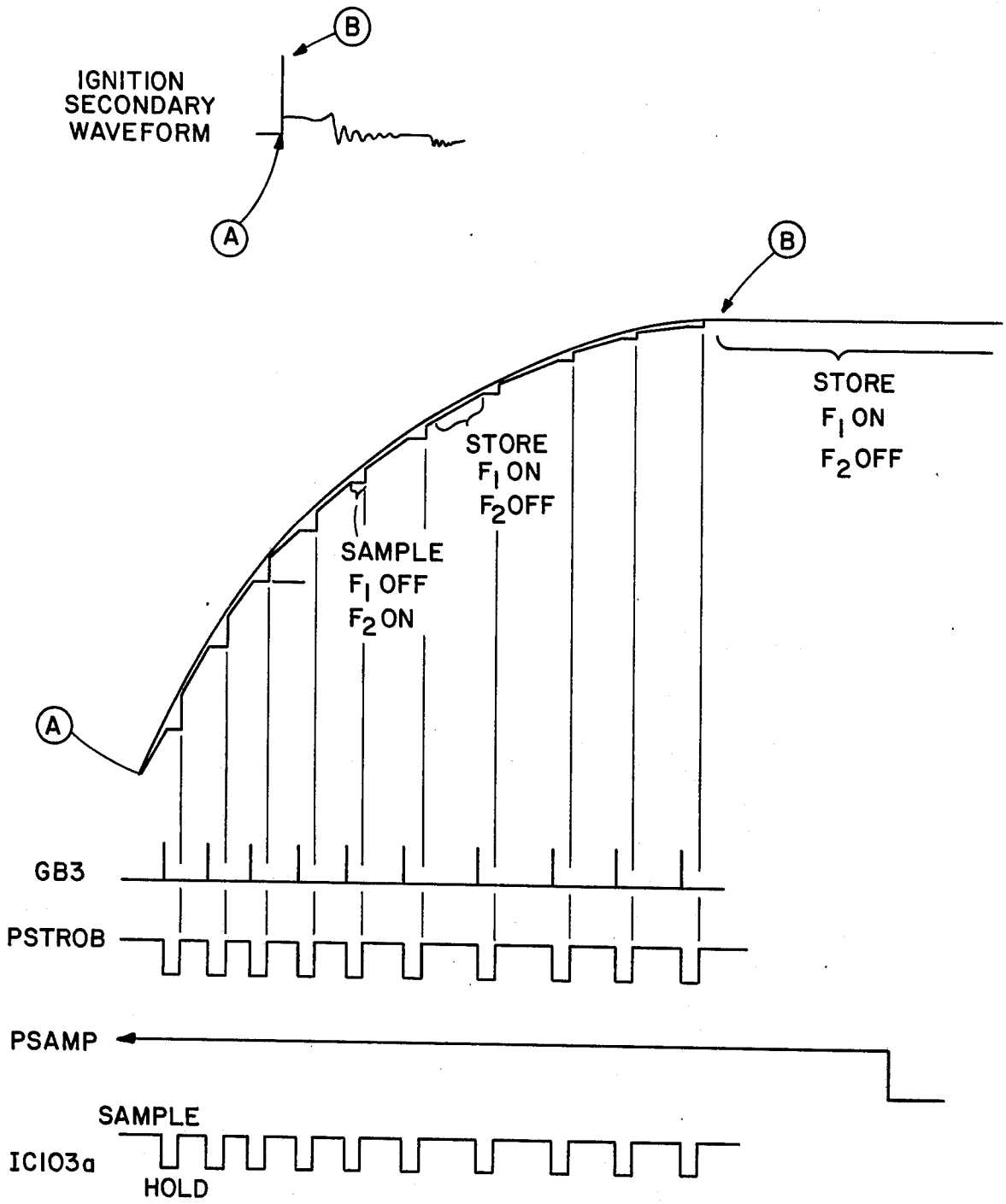
FIG. 7 illustrates an enlarged secondary coil firing voltage and various pulses of the preferred embodiment shown in FIG. 1.

As shown in FIG. 6, the signal CLK01 represents a "1" or high state during the firing and intermediate section of the cylinder ignition cycle, i.e., "points open", and a 0 or low state during the dwell section i.e., "points closed". The terms 1, "0," "high," "low," "ON," "OFF" are used interchangeably herein with respect to digital signals and circuitry. Similarly, the terms "points," "points open," "points closed" are used herein with respect to both conventional and electronic ignition systems.

The signal PSAMP is a sample command pulse, setting a unique interval or cylinder interval for an ignition performance test. The signal PSAMP extends from "points close" to "points close" for consecutive cylinders in the firing order. Thus, the signal PSAMP determines the sample cylinder. In FIG. 6, the signal PSAMP for the cylinder No. 2 is shown. As shown in FIG. 3, the signal PSAMP is controlled by a cylinder selector, e.g., a push button or externally generated code signal issued by the processing unit 20.

The signal DSTROB represents a delayed strobe signal. In quantative terms, the signal DSTROB is the signal CLK01, delayed by 1 to 10°, preferably 2 to 5°. The signal DSTROB begins and ends a few hundred nanoseconds, preferably 500 nanoseconds, after "points open" and "points close," respectively.

The signals CLK01, PSAMP and DSTROB are variable with engine speed. That is, the initiation and duration of the pulses are related to engine speed, such that time scaling is substantially avoided.

Figure 4:
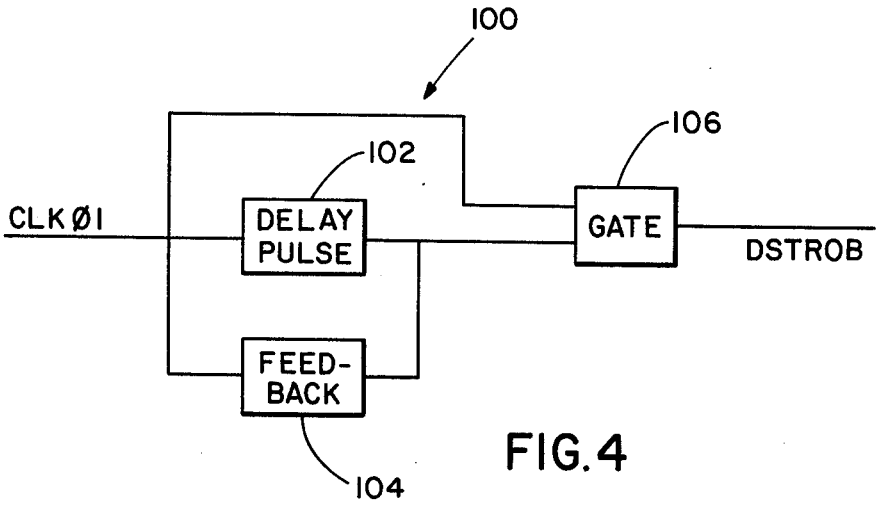
FIG. 4 is a block diagram of an apparatus for generating a signal DSTROB for use in the preferred embodiment shown in FIG. 1.
Figure 5:
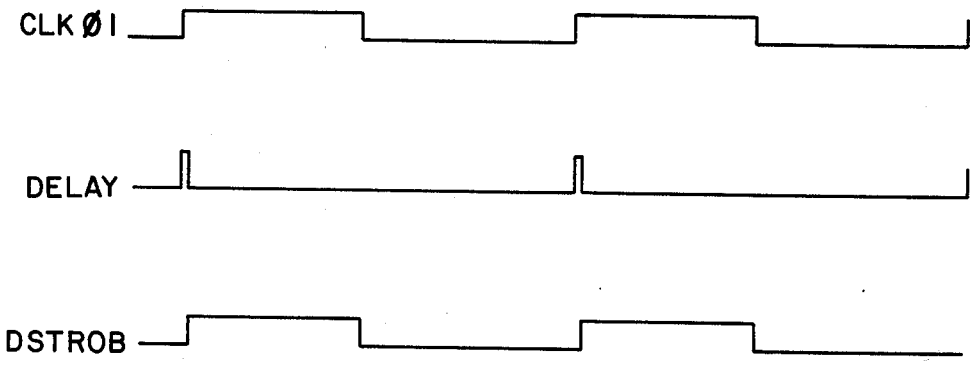
FIG. 5 illustrates various signals generated by the apparatus shown in FIG. 4.

The logic circuitry shown in FIG. 4 generates the signal DSTROB. The logic is designated generally as a delay circuit 100. The delay circuit 100 includes a one-shot multivibrator 102 triggered by the leading edge of the signal CLK01. The multivibrator 102 generates a delay pulse, as shown in FIG. 5, having a variable duration. The width of the delay pulse is inversely proportional to engine speed.

The variation of duration results from the variable time constant feedback, designated 104. The delay pulse is then gated with the signal CLK01 in the gate 106.

The interface 12 also receives enabling pulses from the processing unit 20, which authorize operations of the interface 12. It is to be understood, however, that alternative means for producing such pulses or signals may be used, such as a push-button control panel (not shown).

Figure 2A:
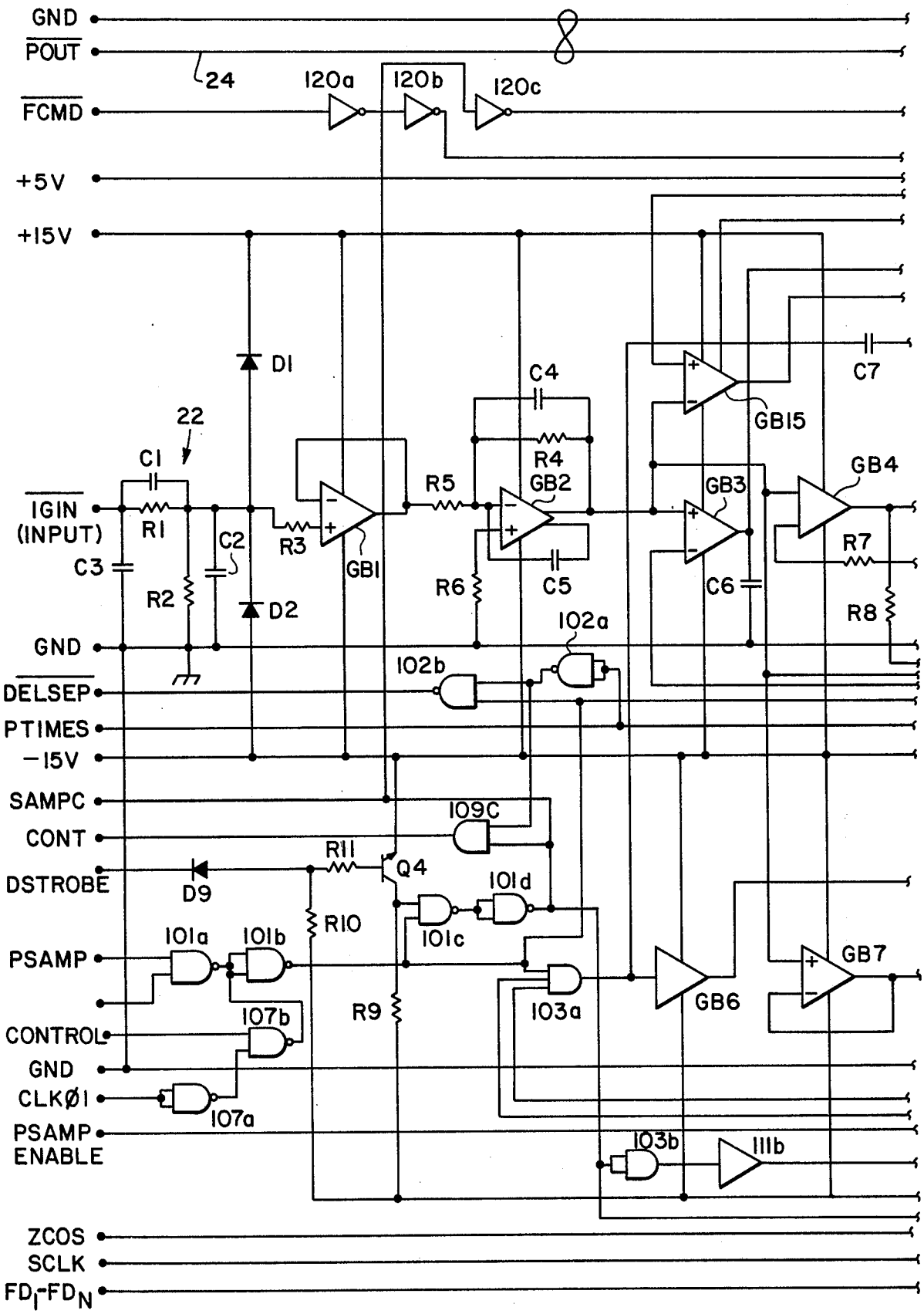
FIG. 2 is a detailed schematic diagram of the preferred embodiment shown in FIG. 1.
Figure 2B:
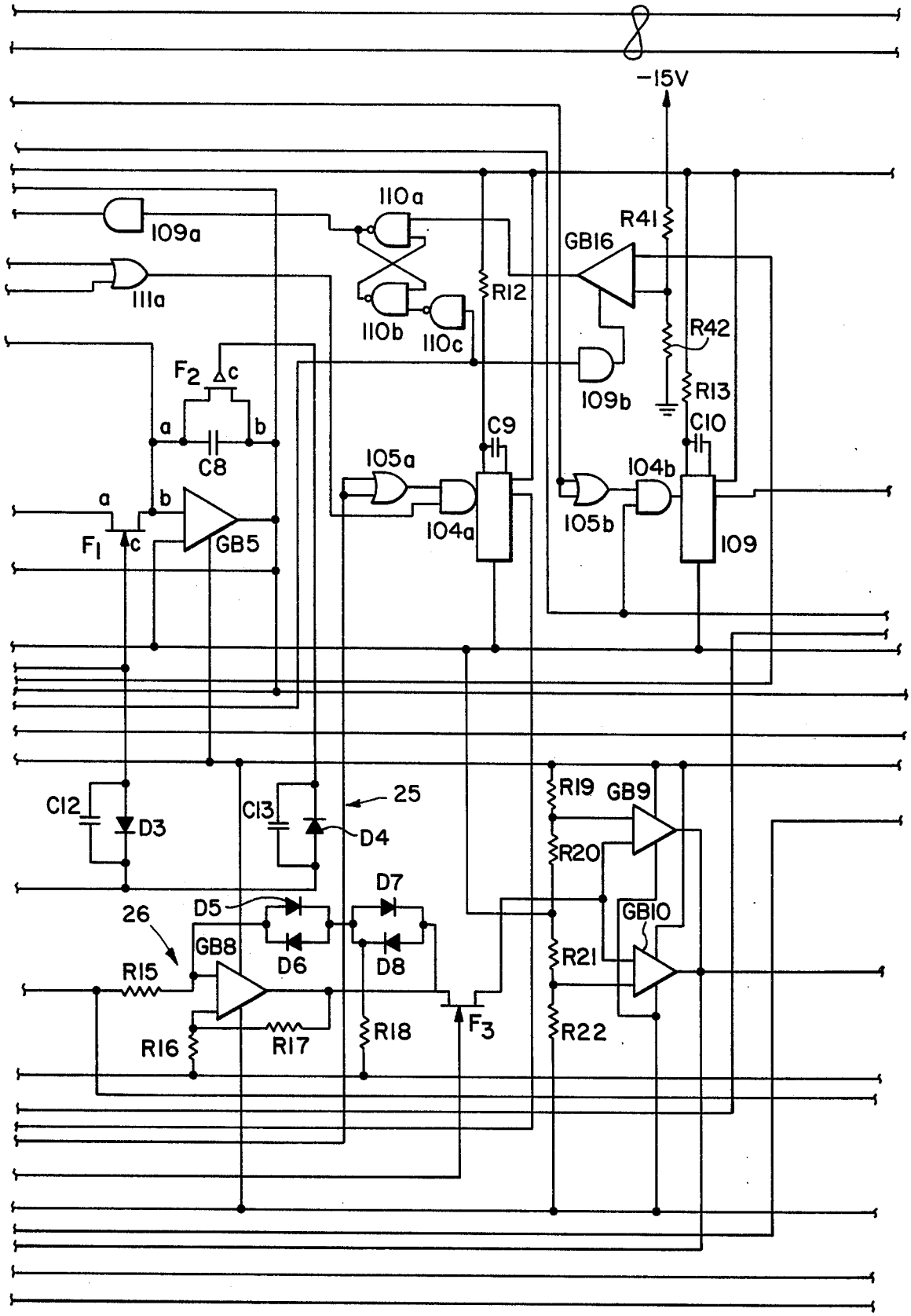
Figure 2C:
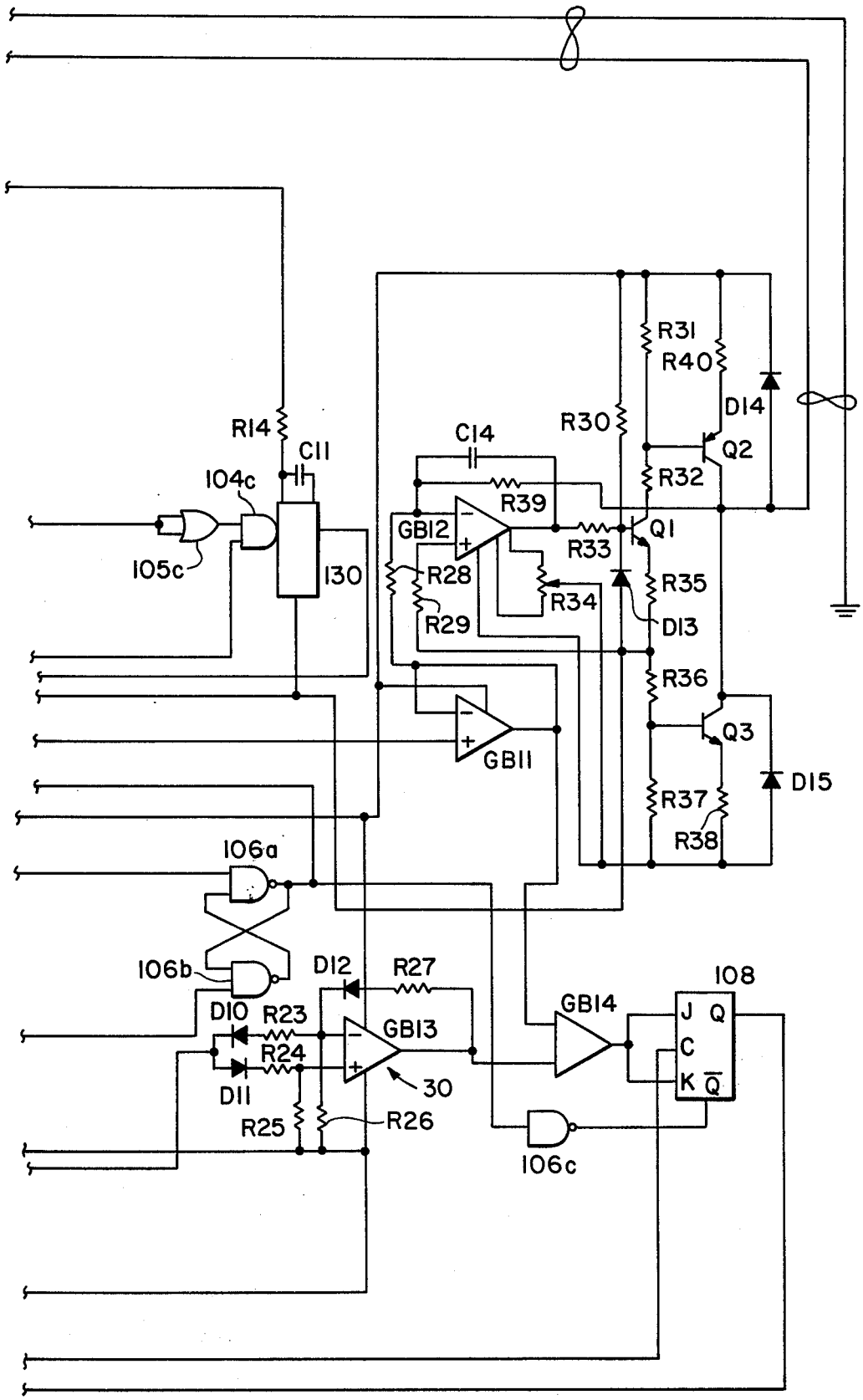

The interface 12 is shown in schematic detail in FIG. 2. The interface 12 includes resistors R1-R42, capacitors C1-C14, diodes D1-D16, amplifier networks GB1-GB16, integrated circuits IC 101*a-d*, 102*a-b*, 103*a-b*, 104*a-c*, 105*a-c*, 106*a-c*, 107*a-b*, 108, 109*a-c*, 110*a-c*, 111*a-b*, 120*a-c*, field effect transistors F1-3 (hereinafter FET), and transistors Q1-4, interconnected as shown.

The secondary coil ignition voltage signal $\overline{\text{IGIN}}$, generally a negative going signal, is received by a compensated attenuator network, generally designated 22. The attenuator network 22 includes the resistors R1, R2 and capacitors C1, C2, C3.

The attenuator network 22 substantially avoids peaking and premature roll-off of the input frequencies. The attenuator network 22 is impedance-matched with the source, i.e., the automobile distributor, such that maximum power is transferred. The capacitor C3, a 0.02 microfarad disc capacitor, dominates over the capacitance of the pick-up 14 and input coupling lead to substantially avoid the varying distributive capacitive effects thereof.

The output of the compensated attenuator network 22 is coupled through the resistor R3, a current limiting 2K ohm resistor, into the amplifier network GB1. The network GB1 is a non-inverting, unity gain amplifier with a bandwidth in excess of one megahertz. The input and output impedances of the network GB1 are in the order of 400 megaohms and 1 ohm, respectively.

The compensated attenuator network 22 and amplifier network GB1 substantially isolate the processor 10 and more particularly the interface 12 from the ignition system of the automobile being tested. The received secondary signal is, therefore, undisturbed, i.e., there is no loading of the secondary coil.

The diodes D1, D2 clamp the positive and negative input terminals of the amplifier network GB1 to ± 15.7 volts. Generally speaking, $\overline{\text{IGIN}}$, subsequent to attenuation, does not exceed a negative 5 volts. However, the shorting of pick-up 14 could result in the direct coupling of thousands of volts into the interface 12. The clamping diodes D1, D2 protect the circuitry of the interface 12 from this potential.

The amplifier network GB2 is a DC coupled, inverting amplifier. The amplifier network GB2 has a gain of five (5) and attenuates frequencies above approximately 50 kilohertz. The amplifier network GB2 has a high slew rate to provide adequate signal outputs under a wide range of engine speeds. The output signal of the network GB2 is IGIN, generally a positive-going signal. The signal IGIN, shown in FIG. 6, is analyzed without further alteration.

The resistor R6 equates input currents through equivalent input impedances. That is, the resistor R6 is substantially equivalent to the parallel ratio of the resistors R4, R5. Thus, under quiescent conditions, the currents flowing into the positive and negative inputs of the amplifier network GB2 are substantially equivalent. The capacitor C5 is a phase lag capacitor for stabilization against high frequency oscillations.

PEAK AMPLITUDE DETECTION

The signal IGIN is received by the amplifier network GB3. The network GB3 is a differential comparator. As shown, the network GB3 compares two input voltages, i.e., IGIN and the output voltage of the amplifier network GB5, and issues or generates a command whenever the difference exceeds a predetermined value. In this preferred embodiment, the predetermined value is in the range of 1 millivolt.

The signal IGIN is also inputted to the network amplifier GB4. The network GB4 is a unity gain input buffer. The output of the network GB4 is coupled through the FET F1 into the amplifier network GB5. The network GB5 is a high input, low output impedance unity gain amplifier. The network GB5 charges the primary storage capacitor C8. As indicated, the voltage of the primary storage capacitor C8, or the output voltage of the network GB5, is compared with IGIN by the network GB3, with a 1 or sample command being issued whenever IGIN slightly exceeds the voltage across the capacitor C8.

As shown, each sample command of the network GB3 triggers the 50 nanosecond one shot multivibrator IC104*a*. The output signal of the multivibrator IC104*a* is referenced PSTROB*. The signal PSTROB* is gated in the AND gate IC103*a* with the signal PSAMP, as a result of a low "control" signal, issued by the unit 20 or a front panel push-button, on the input of integrated circuit IC107*b*. The peak sample enable bus is also set at a low state in this mode by the processor 20 or a push-button panel. The output of the gate IC103*a* is connected to the amplifier network GB6, which effects storage of the last detected voltage value of IGIN.

More particularly, the FET's F1, F2 are controllably conductive devices having main terminals *a*, *b* and a control or gate terminal *c*. The FET's F1, F2 have a low "ON" resistance of 50 to 100 ohms and a high "OFF" resistance of a megaohm or greater. When the FET F1 is conductive, the networks GB4, GB5 are coupled and charge the capacitor C8 to the voltage IGIN. When the FET F2 conducts, the voltage of the capacitor 8 is "dumped".

It should be noted that the interface 12 is a serial or straight-through circuit. As indicated above, the testing occurs only during a given interval, e.g., PSAMP in the peak detection mode. Otherwise, the signal IGIN is directly coupled through the interface 12 to the output, generally designated 24. The output signal, referenced $\overline{\text{POUT}}$ in FIG. 2, is coupled to the display 18 and processor 20.

The FET's F1, F2 are controlled by the network amplifier GB6. The network GB6 is a level translator, providing digital control. For example, in response to a digital 1, the network GB6 issues a +15 volt signal; in response to a 0, the network GB6 issues a −15 volt signal. The response of the network GB6 is coupled to FET's F1, F2 through an FET couple 25, including the capacitors C12, C13 and diodes D3, D4.

The output of the network GB6 thresholds either D3 or D4, thus enabling either the FET F1 or F2, respectively. That is, the network GB6 produces switching action in the FET's F1, F2, thereby alternating charging and dumping.

Whenever the voltage differential is such that the network GB3 is conductive, then the FET F1 goes "ON", after the FET F2 goes "OFF", storing the value of IGIN in the capacitor C8. When the voltage peak of IGIN is experienced, the FET's F1, F2 remain "ON" and "OFF", respectively and the stored voltage remains constant.

The network GB5, having large current capability, rapidly charges the capacitor C8. Further, the effective value of capacitance is approximately the actual value multiplied by the open loop gain of the network GB5. Thus, leakage problems are substantially avoided with a relatively small picofarad capacitor. This also results in a very fast time constant for the charging circuit.

The capacitor C7 is a feed forward compensation capacitor of approximately 30 picofarads. The capacitor C7 provides offset into the input node of the network GB5 to ensure an accurate measurement of the peak voltage of IGIN. That is, by capacitor coupling a portion small percentage of the high speed ramp impressed upon the network GB6 into the input node of the network GB5, the leakage across the FET's F1, F2 is offset, thereby minimizing the error in the voltage across the capacitor C8.

The amplifier network GB15 is a negative detector to sample and hold the peak of negative going excursions of IGIN. Large negative voltages are indicative of lean burning and/or insulation breakdown on "snap" acceleration.

The amplifier network GB15 operates in parallel with the network GB3 through the OR gate IC111*a*. The amplifier network GB16 is a voltage comparator, comparing IGIN to a safe minimum negative voltage. The negative threshold of the network GB16 is set by the resistors R41, R42. The signal SAMPC* enables the network GB16, as the interval SAMPC* provides the time period of suspected large negative excursions.

The output of the network GB16 is coupled to the RS flip-flop including integrated circuits IC110*a*, IC110*b*. In response, the flip-flop enables the AND gate IC109*a*, causing the negative comparator GB15 to function. As such, the interface 12 has bipolar peak detection capabilities.

COIL AND CONDENSER ANALYSIS

The analysis of the ignition coil and condenser requires the development of additional signals. More particularly, the analysis is directed to the intermediate section of the secondary ignition waveform.

With reference to FIG. 2, the signals PSAMP, CLK01 are gated to produce SAMPC*, which is further gated with the signal DSTROB to produce a delayed signal SAMPC. The signal SAMPC is an interrupt signal to the processing unit 20, whereby execution of the appropriate subroutine, stored therein, is initiated. The preferred 2° to 5° delay of the signal SAMPC, caused by gating with the signal DSTROB, is significant as the interrupt occurs nanoseconds into the measurement interval. The delay substantially avoids "cross talk" problems.

The signal SAMPC is also utilized to generate the timing pulses PTIMES and CONT. The signal PTIMES represents the interval of the firing line or the time of spark plug firing. The signal CONT represents the intermediate section of the secondary waveform or the reflected second order oscillations of the secondary waveform, which is to be analyzed.

As shown, the signal IGIN is coupled to the network amplifier GB7, a unity gain, non-inverting isolation amplifier. The output is applied to a zero crossing detector, generally designated 26, including the amplifier network GB8, resistors R15, R16, R17, R18, and diodes D5, D6, D7, D8.

The output of the detector 26, in response to the oscillating portion of the secondary waveform, is substantially a square wave, whose value goes low as the input sinusoidal function crosses zero volts and high as the input again crosses zero. That is, the network GB8 substantially converts the sinusoidal input into a square wave. The networks GB8, GB9, GB10 are coupled through the FET F3, as shown. The controllably conductive FET F3 is enabled, i.e., becomes conductive, in response to the signal SAMPC.

The network amplifiers GB9, GB10 are dual comparators, generating nanosecond pulses in response to the transistions of the network GB8. As network GB8 slews positive, the network GB9 issues a high speed threshold pulse; as the network GB8 slews negative, a pulse is issued by the network GB10. The net output of the networks GB9, GB10 is a repetitive pulse signal ZCOS, shown in FIG. 6.

The signal ZCOS is coupled to the R input of an RS flip-flop, generally designated 28, including integrated circuits IC106*a*, IC106*b*. As shown the signal SAMPC initially sets the S input and the Q output follows. That is, the S input and Q output go high with the signal SAMPC. With the first pulse of ZCOS, representing the first zero crossing of IGIN, the Q output goes low, thereby generating the signal PTIMES.

The signals SAMPC and PTIMES are gated in the integrated circuit IC109*c* to produce the signal CONT. The signals PTIMES, CONT and ZCOS are transmitted to the processing unit 20 for subroutine analysis.

More particularly, the coil and condenser conditions are determined by analysis of the signals PTIMES, CONT and ZCOS. The signal CONT operates as a hardware interrupt, enabling the coil and condenser routine and starting the real time clock. The signal ZCOS provides the number of zero crossings and time therebetween for the secondary waveform, thereby establishing the frequency of the oscillating portion. These quantative values are compared with the known parameters of an operative coil and condenser to determine the condition of the tested coil and condenser. Significantly, the ignition coil is tested in the ignition system, substantially avoiding the disconnection problem discussed previously.

SPARK LINE SLOPE AND SPARK VOLTAGE

As shown in FIG. 2, the network GB7 is also coupled to an absolute value, differential amplifier, generally designated 30, including the network amplifier GB13 and diodes D10, D11. The amplifier GB13 has unity gain. The input signal to the network GB13 positively and negatively coupled through the diodes D11, D10, respectively.

The outputs of the network GB13 and amplifier GB11, a unity gain input amplifier, are connected to the gated inputs of the voltage comparator GB14. Thus, the voltage comparator GB14 functions analogously with the network GB3 in comparing the signal IGIN with the IGIN voltage last stored in the capacitor C8.

The J and K inputs of the integrated circuit IC108, a flip-flop, receive the output of the comparator GB14, setting the Q output high or low. The JK flip-flop IC108 is initially set by the signal PTIMES, as shown in FIG. 2. The signal PTIMES sets the time window for the spark slope and voltage measurements.

The signal SCLK from the processor 20 strobes the clock input of the flip-flop IC108, and data is transferred to the Q output in relation to the clock pulse slew or falling edge. As such, the output of the flip-flop IC108 is a series of pulses FD1, FD2 . . . FDN, within the time slot PTIMES. A pulse FD is not issued unless the difference in voltage to the comparator GB14 exceeds a threshold.

The signal FD represents a timing signal utilized by the processor 20 to generate the signal $\overline{\text{FCMD}}$, a sample fire command. Under the signal $\overline{\text{FCMD}}$, the firing voltages are sampled and stored such that the firing line slope can be determined.

More particularly, the signal enables the integrated circuits IC104*a*, IC104*b*, during the interval of SAMPC, whereby the signal FSTROB* is generated. The signal FSTROB*, analogous to the signal PSTROB*, enables the sample-and-store operation, previously discussed, whereby the firing voltage amplitudes based upon time intervals FD, respectively, are stored and simultaneously transmitted to the processor 20. One pulse or command $\overline{\text{FCMD}}$ is issued during each engine cycle.

To determine the instantaneous firing voltage, a software generated pulse, sufficiently delayed to substantially avoid the exponential decay of the firing line, is issued on the $\overline{\text{FCMD}}$ bus or lead. The firing line voltage is then sampled and held, i.e., the capacitor C8 remains charged to the firing line voltage.

The processor 20 executes a subroutine upon receipt of the firing data. The condition of the spark plug and plug lead can then be determined.

A single preferred embodiment of the present invention has been described and disclosed herein. It is to be understood, however, that various modifications and changes can be made without departing from the true scope and spirit of the present invention, as defined in the following claims.

What is claimed is:

1. In an ignition wave analyzer having coupling means for producing a primary ignition signal and a secondary ignition signal in response to an automobile ignition system and output means, an interface for interconnecting said coupling means and said output means comprising, in combination:

input means for receiving said secondary ignition signal, said secondary ignition signal having a secondary amplitude;

store means for storing said secondary amplitude of said secondary ignition signal to define a stored amplitude;

comparator means for comparing said secondary amplitude and said stored amplitude, said comparator means generating a command pulse whenever the difference between said secondary amplitude and said stored amplitude exceeds a predetermined threshold;

PSTROB means for generating a signal PSTROB in response to said comparator means;

PSAMP means for generating a signal PSAMP in phase with said primary ignition signal;

first gate means for gating said signal PSTROB* and said signal PSAMP to produce a store command signal;

first controllably conductive means for interconnecting said input means and said store means in response to said store command signal; and coupling means for interconnecting said output means and said store means.

2. An interface as claimed in claim 1 wherein said input means includes a compensated attenuator network.

3. An interface as claimed in claim 1 wherein said input means includes a high input impedance amplifier.

4. An interface as claimed in claim 1 further comprising first amplifier means for inverting said secondary ignition signal interposed said input means and said comparator means.

5. An interface as claimed in claim 4 wherein said first amplifier means interposes said input means and said controllably conductive means.

6. An interface as claimed in claim 1 wherein said store means includes a capacitor.

7. An apparatus as claimed in claim 1 wherein said controllably conductive means includes a pair of main terminals and a control terminal.

8. An interface as claimed in claim 7 wherein said main terminals are connected to said input means and said store means, respectively, and said control terminal is connected to said first gate means.

9. An interface as claimed in claim 8 wherein said controllably conductive means is a field effect transistor.

10. An interface as claimed in claim 1 further comprising second controllably conductive means for dumping said stored amplitude.

11. An interface as claimed in claim 10 wherein said second controllably conductive means is responsive to said first gate means, operating in alternation with said first controllably conductive means.

12. An interface as claimed in claim 1 further comprising DSTROB means for generating a signal DSTROB in response to said primary ignition signal.

13. An interface as claimed in claim 12 wherein said PSAMP means further generates a signal CLK01.

14. An interface as claimed in claim 13 further comprising second gate means for gating said signals PSAMP, CLK01 and DSTROB for producing a signal SAMPC.

15. An interface as claimed in claim 14 further comprising:

detector means for detecting zero volt crossings in said secondary ignition signal, said detector means producing a substantially square wave in response thereto, said substantially square wave having transition points;

ZCOS means for producing a signal ZCOS in response to said transition points;

flip-flop means for producing a signal PTIMES in response to said signal SAMPC and said signal ZCOS;

third gate means for gating said signal SAMPC and said signal PTIMES to produce a signal CONT;

third controllably conductive means for inzerconnecting said detector means and said ZCOS means, said controllably conductive means being responsive to said signal SAMPC; and means for coupling said signal CONT and said signal ZCOS to said output means.

16. An interface as claimed in claim 1 further comprising:

second comparator means for comparing said secondary amplitude and said stored amplitude, said second comparator means generating a signal whenever the difference between said secondary amplitude and said stored amplitude exceeds a second predetermined threshold;

PTIMES means for generating a signal PTIMES; and second flip-flop means for generating a pulse series FD in response to said second comparator means and said PTIMES means, said first controllably conductive means being responsive to said signal FD.

17. An interface as claimed in claim 16 further comprising processor means for generating a signal $\overline{\text{FCMD}}$ in response to said signal FD, said PSTROB* means producing a signal FSTROB* in response to said signal $\overline{\text{FCMD}}$.

* * * * *